US010393485B1

(12) United States Patent
Painter et al.

(10) Patent No.: US 10,393,485 B1
(45) Date of Patent: Aug. 27, 2019

(54) MECHANICAL BROADHEAD

(71) Applicant: Blade Broadheads LLC, Xenia, OH (US)

(72) Inventors: Heath Painter, Xenia, OH (US); Glenn Clark, Xenia, OH (US)

(73) Assignee: Blade Broadheads, LLC

( * ) Notice: Subject to any disclaimer, the term of this patent is extended or adjusted under 35 U.S.C. 154(b) by 0 days.

(21) Appl. No.: 16/218,677

(22) Filed: Dec. 13, 2018

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 5,078,407 A 1/1992 Carlston et al.
6,322,464 B1 11/2001 Sestak
6,830,523 B1 12/2004 Kuhn
7,377,869 B2 * 5/2008 Wohlfeil ..... F42B 6/08 473/583
8,128,521 B1 3/2012 Ulmer
8,197,367 B2 6/2012 Pulkrabek et al.
8,628,438 B1 * 1/2014 Cooper ..... F42B 6/08 473/583
9,303,963 B1 * 4/2016 Ford ..... F42B 6/08
2019/0086186 A1 * 3/2019 Kozlik ..... F42B 6/08

* cited by examiner

*Primary Examiner* — John A Ricci
(74) *Attorney, Agent, or Firm* — Wood Herron & Evans LLP

(57) ABSTRACT

Provided is a mechanical broadhead for an arrow shaft includes a ferrule attachable to the arrow shaft and having a body with a longitudinal centerline that is substantially coaxial with the arrow shaft when attached. The ferrule body has a longitudinal slot and at least one blade is pivotally mounted to the ferrule, at least partially within the longitudinal slot. The blade is movable about a pivot between folded and deployed positions and extends generally in a forward direction from the pivot when in the folded position. The blade is pivotable from the folded position in a first direction and the pivot is positioned on the ferrule opposite the blade's first pivot direction at a point beyond the longitudinal centerline.

10 Claims, 4 Drawing Sheets

MECHANICAL BROADHEAD

TECHNICAL FIELD

The present invention relates to an arrowhead for hunting game. More particularly, it relates to a mechanical broadhead having pivoting blades that deploy upon contact with a target.

BACKGROUND

A broadhead is an arrowhead or tip particularly intended for hunting game. Unlike a target tip, a broadhead has sharp edges or blades that create a profile significantly larger than the diameter of the arrow shaft for penetrating the hide of a game animal and humanly killing it. A broadhead may be considered "fixed" (i.e., having fixed blades that do not move), "mechanical" (i.e., having moving parts that expand the radius profile of one or more blades upon impact), or "hybrid" (i.e., having a combination of fixed and deployable blades). Among mechanical broadheads, some may have blades that are deployed upon axial displacement to pivot or slide from an in-flight position to a deployed position. Others have blades that are hinged at a fixed point with the blade being positioned either forwardly or aftwardly of the pivot point. Prior designs in which the blades extend forwardly of an aft pivot point during flight have been known to consume a significant amount of kinetic energy to deploy because of the steep angle of the folded blade relative to the direction of flight and opposite direction of force applied by impact with the target.

Mechanical broadheads allow the aerodynamic profile of the projectile to be minimized for flight, maintaining velocity and energy to be transferred to the target. Mechanical broadheads seek to maximize mechanical advantage and consume the minimum amount of energy to activate blades, which would otherwise be transferred to the target. A mechanical broadhead may provide an enlarged entry wound, as well as enlarging the wound channel to increase internal damage, resulting in a more human taking of the game animal.

SUMMARY OF THE INVENTION

The present invention provides a mechanical (or hybrid) broadhead that maximizes the torque produced by force applied against the blade tip by contact with a target. This is achieved by maximizing the resting angle at which force is applied by positioning the pivot point of the blade on the opposite side of the axial centerline from the direction which the blade pivots to it deployed position.

In one embodiment, a mechanical broadhead for an arrow shaft includes a ferrule attachable to the arrow shaft and having a body with a longitudinal centerline that is substantially coaxial with the arrow shaft when attached. The ferrule body has a longitudinal slot and at least one blade is pivotally mounted to the ferrule, at least partially within the longitudinal slot. The blade is movable about a pivot between folded and deployed positions and extends generally in a forward direction from the pivot when in the folded position. The blade is pivotable from the folded position in a first direction and the pivot is positioned on the ferrule opposite the blade's first pivot direction at a point beyond the longitudinal centerline.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
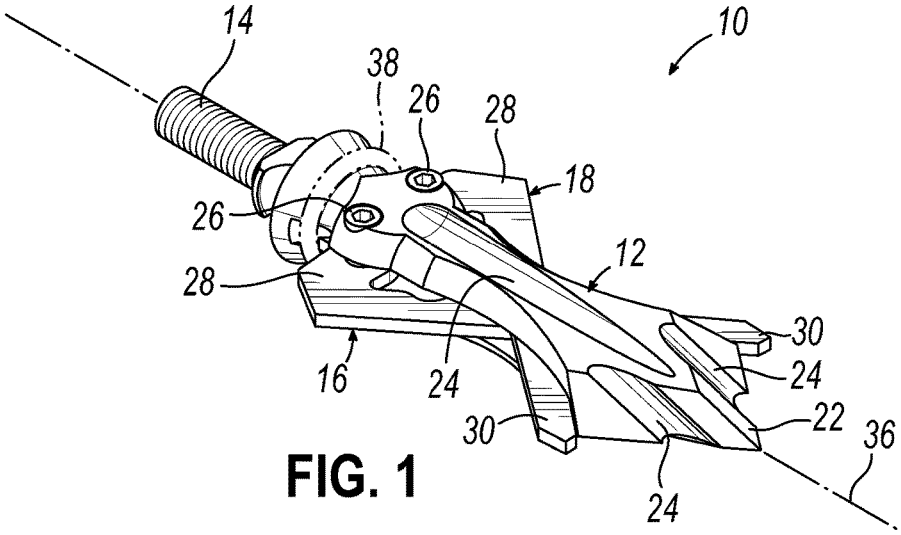
FIG. 1 is an isometric view of a mechanical broadhead according to an embodiment of the present invention with blades in a folded, in-flight position.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations may not be shown or not be described in detail to avoid obscuring aspects of the embodiments.

Figure 2:
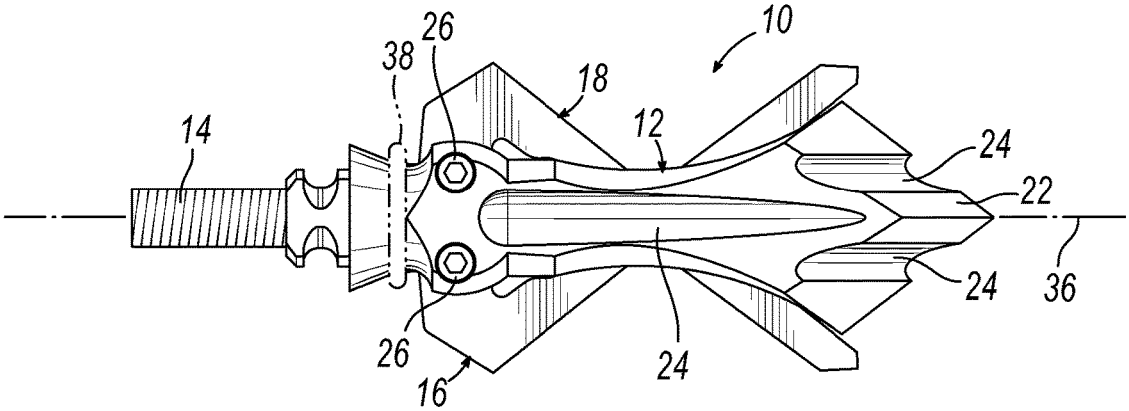
FIG. 2 is a top plan view thereof.
Figure 3:
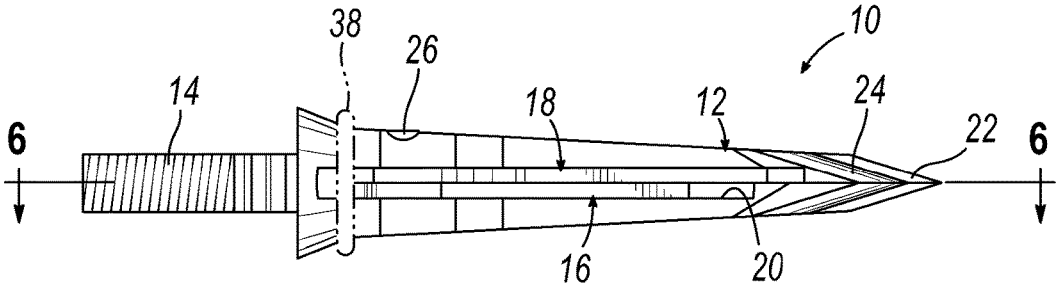
FIG. 3 is a side elevation view thereof.
Figure 4:
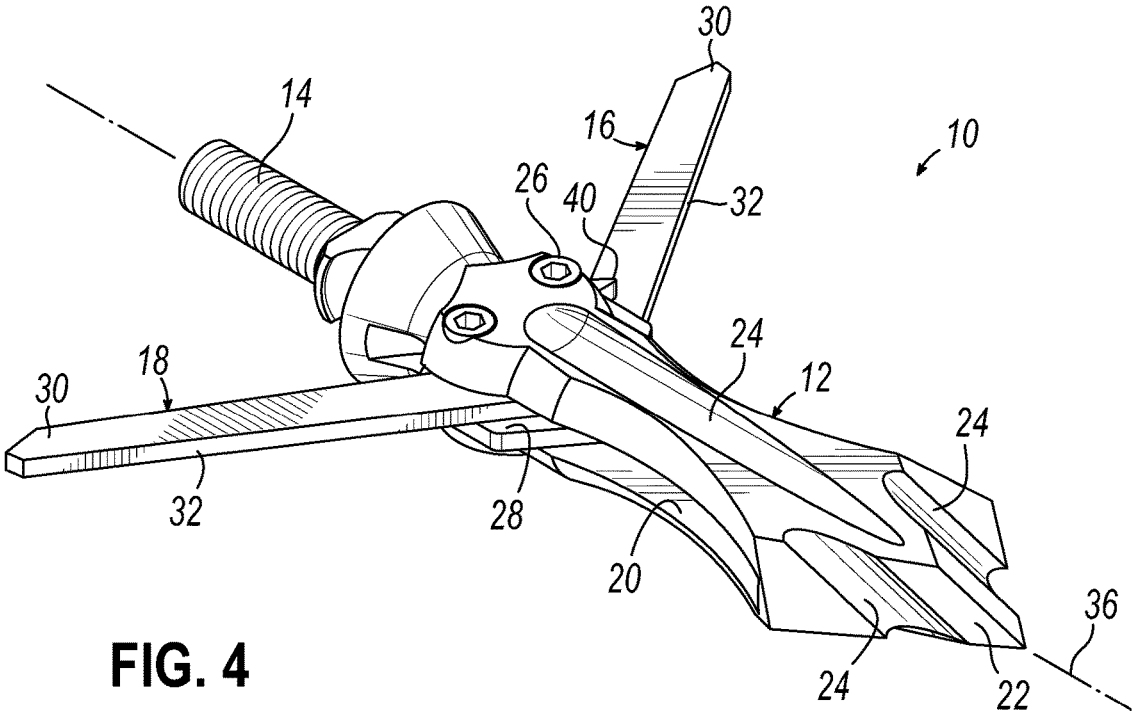
FIG. 4 is an isometric view with the blades in a deployed position.
Figure 5:
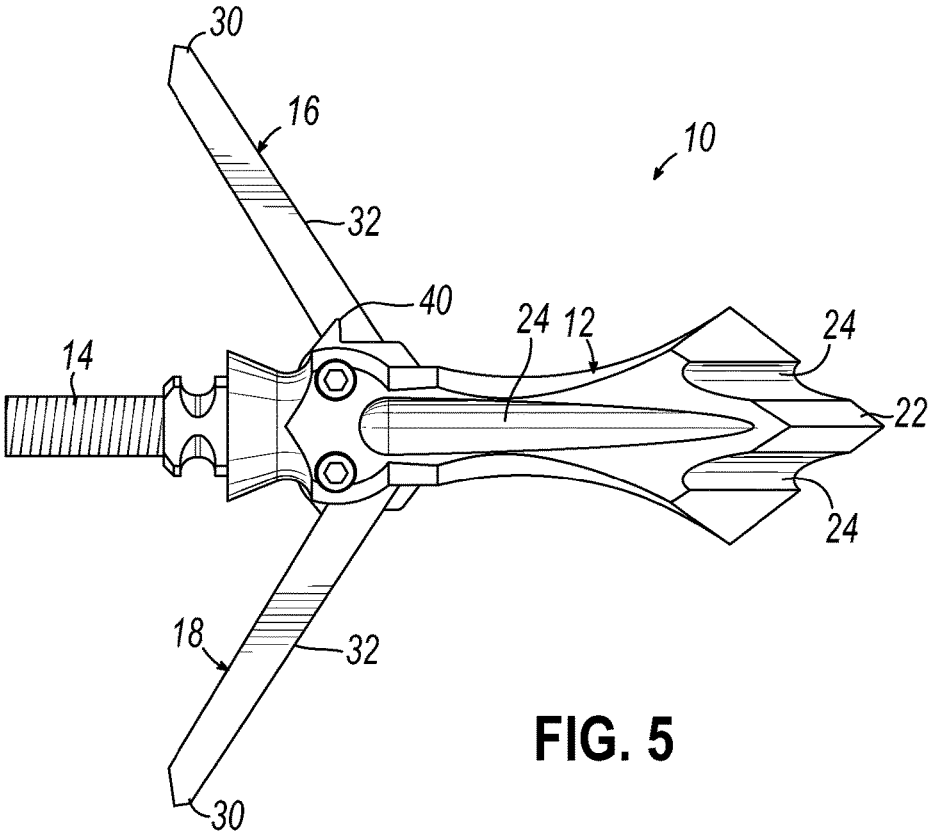
FIG. 5 is a top plan view thereof with the blades deployed.

Referring first to FIGS. 1-3, therein is shown a broadhead 10 according to one embodiment of the invention. It includes a main body or ferrule 12. The ferrule 12 includes a base portion 14 which may be threaded or otherwise configured for attachment to an arrow shaft (not shown). As will be described in greater detail below, first and second blades 16, 18 are pivotally attached to the ferrule 12 for movement between a closed position (FIGS. 1-3) and a deployed position (FIGS. 4-5). The body of the ferrule includes a transverse opening 20 that extends less than the full length of the body and in which the blades 16, 18 nest. The ferrule 12 body includes a tip portion 22 that provides the leading edge of the broadhead 10 for initial penetration of the target. The illustrated embodiment could be considered a hybrid broadhead, as the tip portion 22 of the ferrule 12 includes fixed cutting blades. The specific shape and details of parts of the ferrule 12 and the tip portion 22 are not critical to the present invention, but may include one or more fullers 24.

As previously described, the blades 16, 18 mount to the ferrule 12 on pivot pins 26, which may be in the form of a threaded set screw or any other suitable type of pin. In the folded position (FIGS. 1-3), each blade 16, 18 extends from a base end 28 at which it is pivotally mounted to the ferrule 12 with a free end or tip extending substantially toward the leading end or tip portion 22 of the ferrule 12. At least the leading edges 32 of the blades 16, 18 are sharpened to enhance penetration of the target. Because the blades 16, 18 cross each other in both the folded and deployed positions, each is offset by the thickness of each blade, as shown in FIG. 3. The blades 16, 18 cross in the transverse opening 20 of the ferrule 12.

Figure 6:
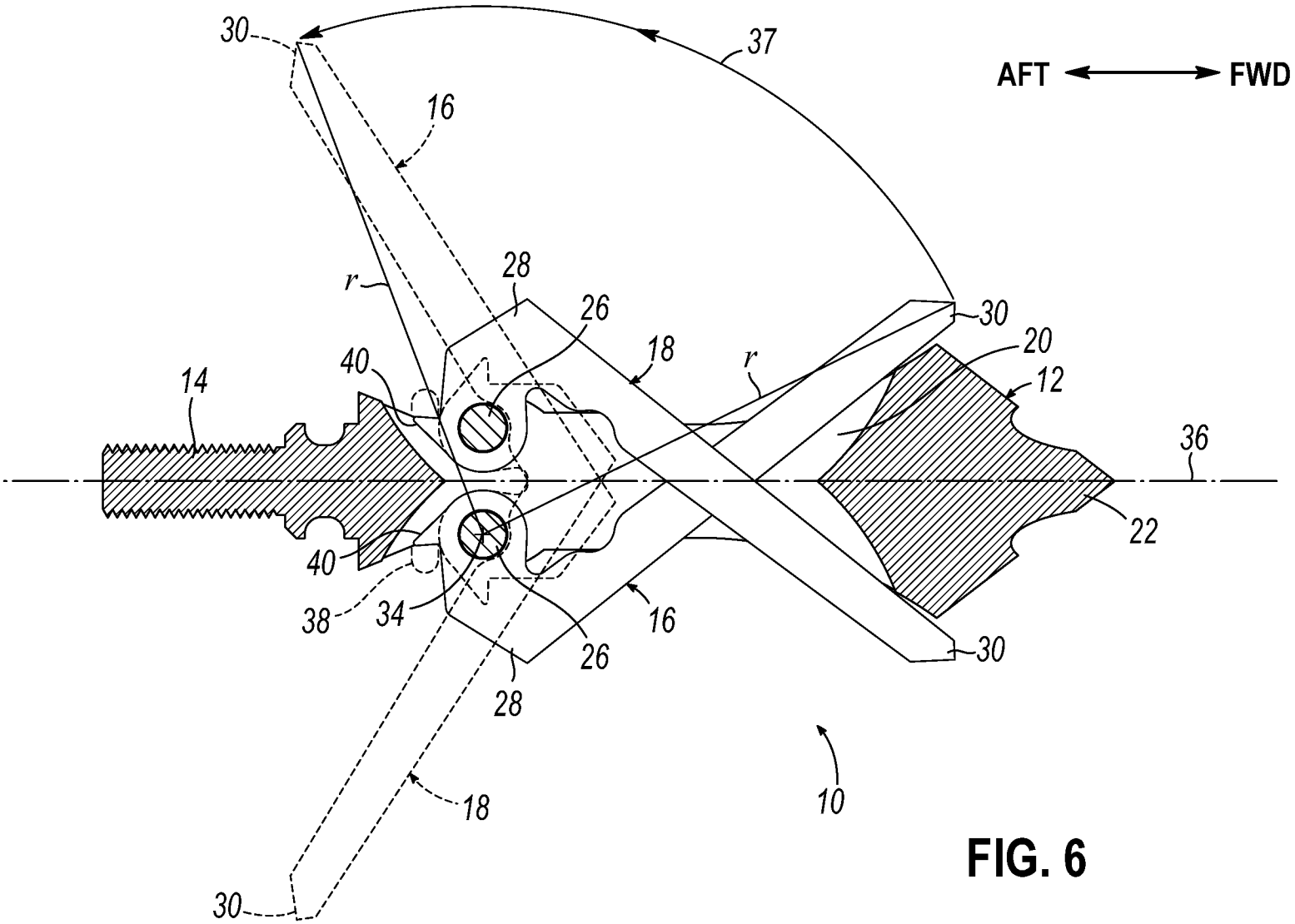
FIG. 6 is a top sectional view taken substantially along the line 6-6 of FIG. 4 with the deployed position of blades shown in phantom line.

Referring now in particular to FIG. 6, according to an aspect of one embodiment of the invention, the pivot point 34 (center point of each respective pivot pin 26) of each blade 16, 18 is laterally offset beyond the centerline 36 opposite the direction toward which the blade 16, 18 pivots or swings for deployment. In the illustrated embodiment, because the pivot pins 26 extend through the transverse opening 20, the base portion 28 of each blade 16, 18 is shaped to curve around the pivot pin 26 of the opposite blade 16, 18 when deployed, so that the tip end 30 can move to a position further aft with leading edges 32 raked to the rear beyond perpendicular to the centerline 36.

In mechanical broadheads having one or more blades that project forward from a pivot point in the stowed, in-flight position, the desire to minimize the overall folded profile results in the blades resting at a very small angle relative to the centerline of the arrow shaft and ferrule. In previous designs, the pivot point has been either at the centerline or offset from the centerline in the direction toward which the blade pivots. Examples are shown in U.S. Pat. Nos. 5,078,407 and 8,128,521. This can provide a compact profile but increases the amount of energy (force) consumed to begin deployment of the blades. Other prior designs have sought to increase the angle by using radial extensions of the blades at their tips. Examples are shown in U.S. Pat. Nos. 6,322,464; 6,830,523; and 9,303,963. But this results in an increased profile during flight and reduced cutting profile when deployed, both of which are undesirable. In contrast, the present invention provides the desired compact profile while maximizing the angle at which the initial deploying force is applied to the tip of the blade.

Figure 7:
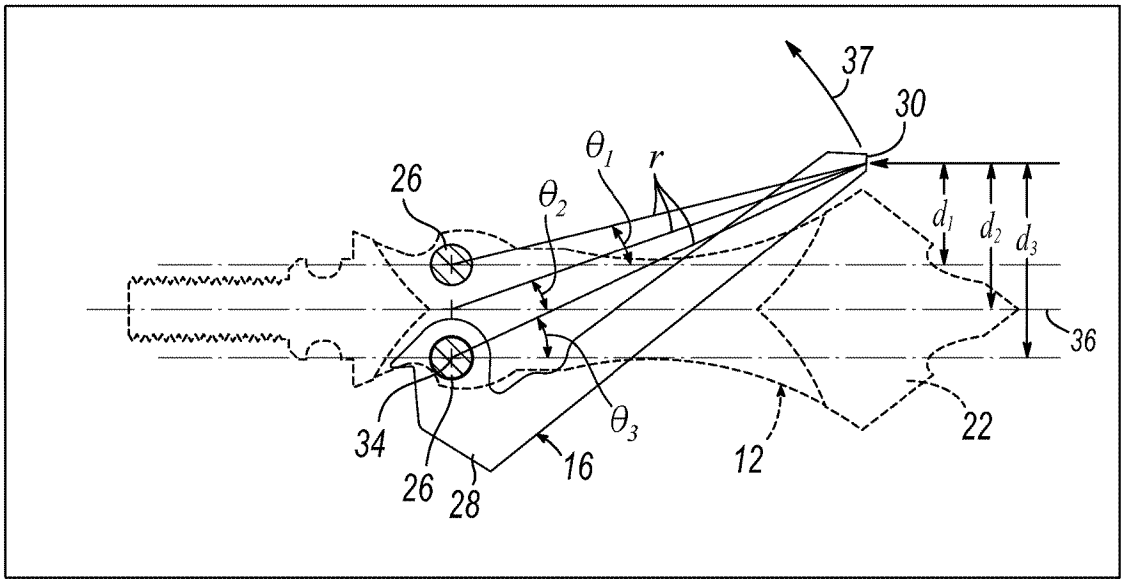
FIG. 7 is a schematic view illustrating the torque advantage of the present invention.

Referring now to FIGS. 6 and 7 (FIG. 7 showing only one blade 16 for clarity), the blade 16 is mounted on a pivot pin 26 which is on the opposite side of the centerline 36 from the direction of swing or pivot, shown by arrow 37. This allows the tip 30 of the first blade 16 to be offset from its pivot point 34 a distance $d_3$ when folded. This distance $d_3$ extends across the axial center line 36. Thus, the radius r of the blade 16 is situated at a maximized angle $\theta_3$. This offset distance $d_3$ and corresponding angle $\theta_3$ are both greater than if the pivot point were located at either the centerline 36 ($d_2$, $\theta_2$) or was offset toward the pivotal direction ($d_1$, $\theta_1$).

Figure 8:
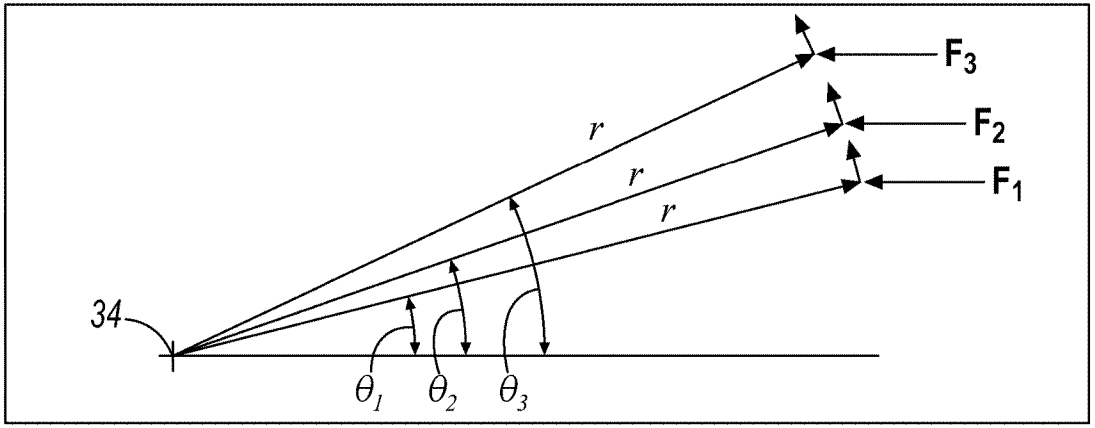
FIG. 8 is a vector diagram illustrating the torque advantage of the present invention.

Referring now also to the vector diagram of FIG. 8, the amount of torque (T) required to pivot the blade 16 may be expressed by the equation:

$$T=rF \sin \theta.$$

Given that the amount of force applied against the tip 30 of the blade 16 at its radius r when the broadhead 10 contacts the target will be fixed (mass×acceleration, determined by the arrow's flight), the amount of torque T required is reduced as the angle θ of the blades' radius is increased. Accordingly, less energy is consumed in initiating movement of the blade, which can instead be transferred to the target.

The advantage is minimized as the blade approaches a right angle to the centerline 36, where torque reaches it maximum when the angle is 90 degrees, as sin(90)=1. However, the most critical point in the deployment of the blade 16 is the force consumed to initiate movement from the folded position upon first contact with the target. It is at this critical point the present invention provides maximum advantage. Under typical conditions (depending on impact velocity and angle), the blades 16, 18 will fully deploy before penetrating the hide of the target, maximizing the size of the entry wound to enhance blood loss.

As depicted in phantom in FIGS. 1-3 and 6, an elastomeric band or O-ring optionally may be used to temporarily retain the blades 16, 18 in the folded position. A spur portion 40 at the base end 28 of each blade 16, 18 is held by the elastic band 38. Given the difference in leverage and comparatively overwhelming force applied to the tips 30 of the blades 16, 18 upon contact with the target, the elastic band 38 is easily displaced or broken, allowing the blades 16, 18 to swing to the deployed position without significant hinderance. The shape of the ferrule 12 at the location of the folded spurs 40 (an annular groove) can minimize the profile of the elastic band 38 during flight.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A mechanical broadhead for an arrow shaft, comprising:

a ferrule attachable to an arrow shaft and having a body with a longitudinal centerline that is substantially coaxial with the arrow shaft when attached, the ferrule body having a longitudinal slot; and at least one blade pivotally mounted to the ferrule at least partially within the longitudinal slot and movable about a pivot between folded and deployed positions, the blade extending generally in a forward direction from the pivot when in the folded position and being pivotable from the folded position in a pivot direction, wherein the pivot is positioned on the ferrule at a location off the longitudinal centerline in a direction opposite the blade's pivot direction.

2. The broadhead of claim 1, wherein the blade has a cutting edge along a leading side.

3. The broadhead of claim 2, wherein the longitudinal slot is open to opposite sides of the ferrule and the blades are configured to pivot in substantially opposite directions from each other.

4. The broadhead of claim 2, wherein each blade is mounted on a pivot pin supported by the ferrule.

5. The broadhead of claim 4, wherein each blade includes a base portion having a notch that when the blade is deployed engages the pivot pin of another blade.

6. The broadhead of claim 1, comprising at least two blades.

7. The broadhead of claim 1, wherein each blade includes a base portion having a spur and an elastomeric band wrapped onto the ferrule retains the spur to retain the blade in the folded position during flight.

8. The broadhead of claim 1, wherein the ferrule includes a leading end forward of the slot with a cutting edge.

9. The broadhead of claim 8, wherein the ferrule includes at least one fuller on an outer surface.

10. The broadhead of claim 1, wherein the ferrule includes at least one fuller on an outer surface.

* * * * *